US010632638B2

(12) United States Patent
Tedeschi et al.

(10) Patent No.: US 10,632,638 B2
(45) Date of Patent: Apr. 28, 2020

(54) APPARATUS FOR PROCESSING, IN PARTICULAR FOR CUTTING A CORRESPONDING MATERIAL

(71) Applicant: BIERREBI ITALIA S.R.L., Sasso Marconi (Bologna) (IT)

(72) Inventors: Paolo Tedeschi, Monzuno (IT); Mauro De Gennaro, San Lazzaro di Savena (IT)

(73) Assignee: BIERREBI ITALIA S.R.L., Sasso Marconi (Bologna) (IT)

( * ) Notice: Subject to any disclaimer, the term of this patent is extended or adjusted under 35 U.S.C. 154(b) by 100 days.

(21) Appl. No.: 15/317,146

(22) PCT Filed: Jun. 11, 2015

(86) PCT No.: PCT/IB2015/054428
§ 371 (c)(1),
(2) Date: Dec. 8, 2016

(87) PCT Pub. No.: WO2015/189801
PCT Pub. Date: Dec. 17, 2015

(65) Prior Publication Data

US 2017/0136647 A1 May 18, 2017

(30) Foreign Application Priority Data

Jun. 13, 2014 (IT) ..... BO2014A0334

(51) Int. Cl.
*B26D 7/01* (2006.01)
*B26D 5/00* (2006.01)
(Continued)

(52) U.S. Cl.
CPC ..... *B26D 7/015* (2013.01); *B26D 5/005* (2013.01); *B26F 1/3826* (2013.01); *D06H 7/24* (2013.01); *B26F 1/3813* (2013.01)

(58) Field of Classification Search
CPC ..... B26D 7/015; B26D 7/18; B26D 5/005; B26D 7/1854; D06H 7/24; Y10S 83/941;
(Continued)

(56) References Cited

U.S. PATENT DOCUMENTS 3,719,113 A 3/1973 Gerber et al.
3,892,614 A * 7/1975 Levy ..... B29C 65/008 361/225
(Continued)

FOREIGN PATENT DOCUMENTS

CN 2053000 U 2/1990
DE 35 08 514 A1 9/1986
(Continued)

OTHER PUBLICATIONS

International Search Report, dated Nov. 26, 2015, from corresponding PCT application.
(Continued)

*Primary Examiner* — Ghassem Alie
(74) *Attorney, Agent, or Firm* — Young & Thompson

(57) ABSTRACT

An apparatus for processing, in particular for cutting, a material, that provides a surface for supporting and resting the material, and includes elements that generate a field of electrostatic attraction of the material on the supporting surface.

28 Claims, 2 Drawing Sheets

(51) Int. Cl.
*D06H 7/24* (2006.01)
*B26F 1/38* (2006.01)

(58) Field of Classification Search
CPC ..... Y10T 83/0453; Y10T 83/242; Y10T 83/6579; Y10T 83/0605; D06F 1/005; B26F 1/3826; B26F 1/3813
USPC ..... 83/451, 155, 109, 168, 422, 227, 276, 83/940, 941, 497, 450, 455, 676, 936
See application file for complete search history.

(56) References Cited

U.S. PATENT DOCUMENTS 4,010,304 A 3/1977 Cohen
4,391,168 A 7/1983 Gerber et al.
4,581,965 A * 4/1986 Gerber ..... B26D 7/1854 15/1.51
5,228,373 A * 7/1993 Welsch ..... B65H 5/004 271/208
7,047,855 B2 * 5/2006 Beccari ..... B26D 7/015 83/227
2005/0077171 A1 4/2005 Hagemann et al.
2012/0247290 A1 * 10/2012 Leyens ..... B26D 3/28 83/23

FOREIGN PATENT DOCUMENTS

DE 195 20 260 A1 4/1996
DE 299 23 244 U1 10/2000
EP 1 233 851 B1 8/2002
EP 1 516 838 A2 3/2005
FR 2 279 687 A1 2/1976
WO 01/39941 A1 6/2001
WO 03/103907 A2 12/2003

OTHER PUBLICATIONS

International Search Report issued in Application No. PCT/IB2016/054678, dated May 31, 2017.

* cited by examiner

APPARATUS FOR PROCESSING, IN PARTICULAR FOR CUTTING A CORRESPONDING MATERIAL

TECHNICAL FIELD

This invention relates to an apparatus for processing, in particular for cutting a corresponding material.

The material preferably comprises a respective layer, especially in tape- or band-like form, preferably in the form of a fabric or the like, and especially used for making corresponding pieces of clothing, that is, for garments, apparel, or the like.

BACKGROUND ART

There are prior art apparatuses for cutting a fabric or the like, especially for making corresponding pieces of clothing, that is, garments, apparel, or the like, the apparatuses having a respective supporting surface, in particular for supporting the material, and means for cutting the material on the supporting surface, in particular in the form of a respective blade for cutting the material on the supporting surface.

In the sector of cutting fabrics for garments in general, a problem particularly felt concerns the inability of these prior art machines to keep the fabric to be cut perfectly still during the cutting of the fabric, that is to say, more specifically, perfectly flat. Therefore, with the use of prior art cutting apparatuses, it is not possible to obtain pieces for corresponding items of clothing which have optimum and desired dimensions and workmanship.

More specifically, according to the prior art, suction means are normally used in order to keep the fabric adhering to the supporting surface, sucking the material onto the supporting surface, thanks also to the application of an outer layer of plastic film. However, this mode of adhesion of the fabric to the supporting surface results in a significant energy consumption and the use of excessive material for making the outer plastic film, without, however, being able to retain in an optimum or homogeneous fashion the material to be cut along the entire and corresponding surface, with the consequent achievement of pieces for garments which do not have optimum and desired dimensions and workmanship.

Alternatively, according to another prior art cutting technique, the material is retained by means of a pair of presser rollers which slide on the same material and between which there are corresponding cutting means.

However, also in this case, the retaining of the material on the respective supporting surface is not optimum.

The field also feels the need for an apparatus for processing, in particular for cutting a material, which allows an efficient cutting operation to be performed and which has a relatively low construction cost.

AIM OF THE INVENTION

This invention proposes a novel solution, alternative to the solutions known up to now and which can overcome one or more of the above mentioned disadvantages and/or meet one or more of the requirements mentioned in or inferable from the above.

It is accordingly provided an apparatus for processing, in particular for cutting, a material, the material preferably comprising a respective layer, especially in tape- or band-like form, preferably in the form of fabric or the like, and being especially for making corresponding pieces for clothing, that is, for garments, apparel, or the like; the apparatus having a respective surface for supporting, in particular for resting, the material and, preferably, means for cutting the material, in particular located on the supporting surface; the apparatus being characterised in that it comprises means designed to generate a field of electrostatic attraction of the material on the supporting surface.

In this way, it is possible to obtain a particularly effective stationary retaining of the material on the supporting surface, and in particular on the surface on which the material is cut, thus obtaining an optimum processing of the material, in particular, pieces cut with optimum and desired workmanship.

BRIEF DESCRIPTION OF THE DRAWINGS

These and other innovative aspects of the apparatus, or specific advantageous embodiments, are set out in the appended claims and its technical features and advantages are apparent from the detailed description which follows of a preferred, advantageous embodiment of it, which must be considered purely as a non-limiting example. the description being made with reference to the accompanying drawings, in which:

DETAILED DESCRIPTION OF PREFERRED EMBODIMENTS OF THE INVENTION

Figure 1:
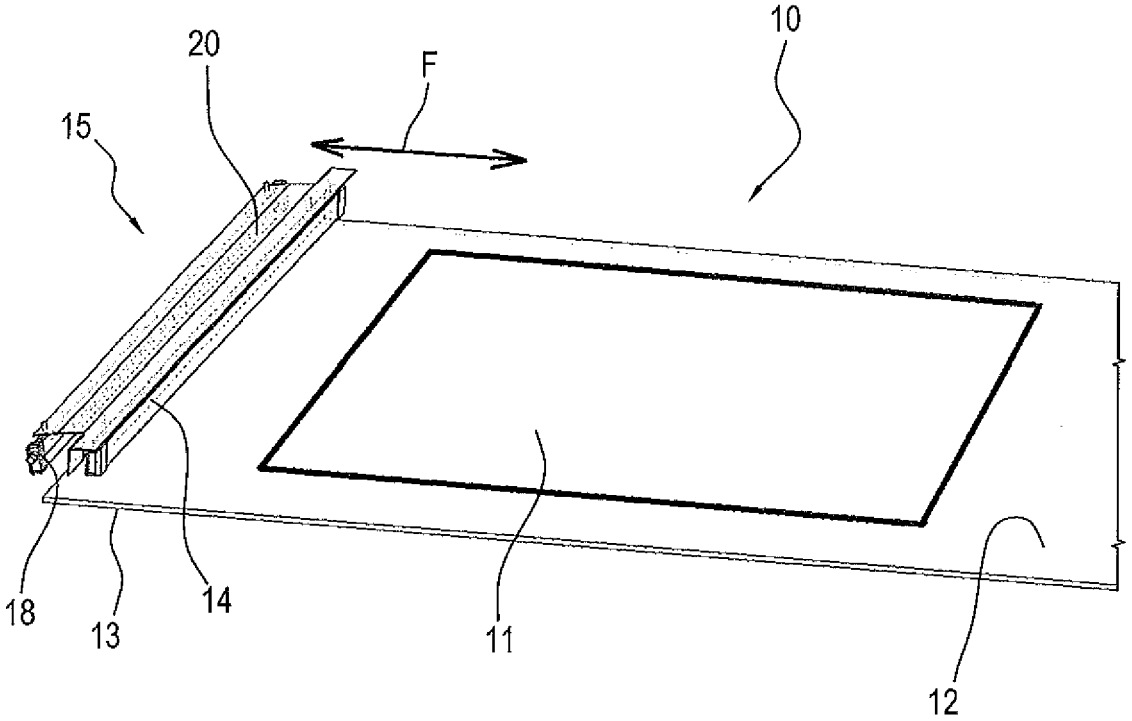
FIG. 1 is a perspective schematic view of a preferred embodiment of the apparatus according to this invention.
Figure 2:
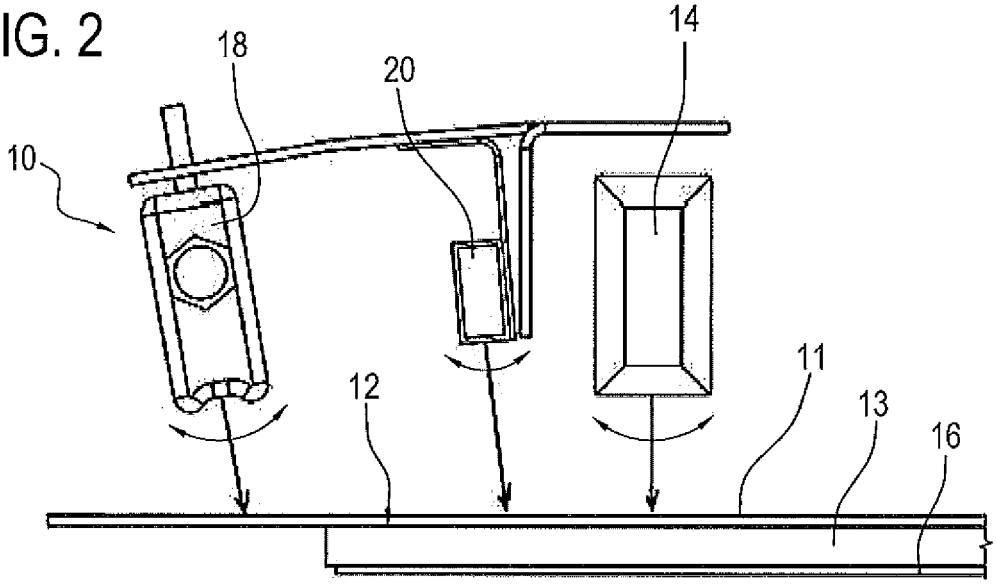
FIG. 2 is a schematic side view of a detail of the preferred embodiment of the apparatus according to this invention.
Figure 3A:
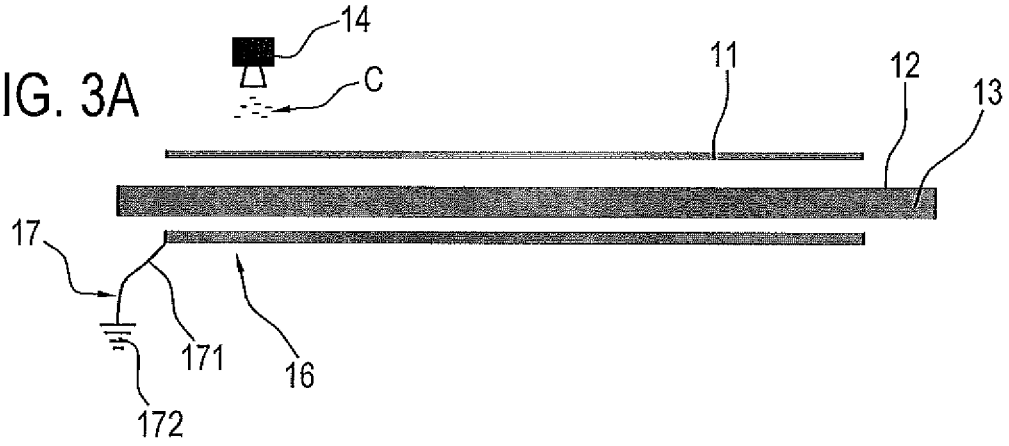
FIGS. 3A to 3D illustrate different steps which allow the generation of a field of electrostatic attraction of the material on the supporting surface of the same material in the preferred embodiment of the apparatus according to this invention.
Figure 3B:
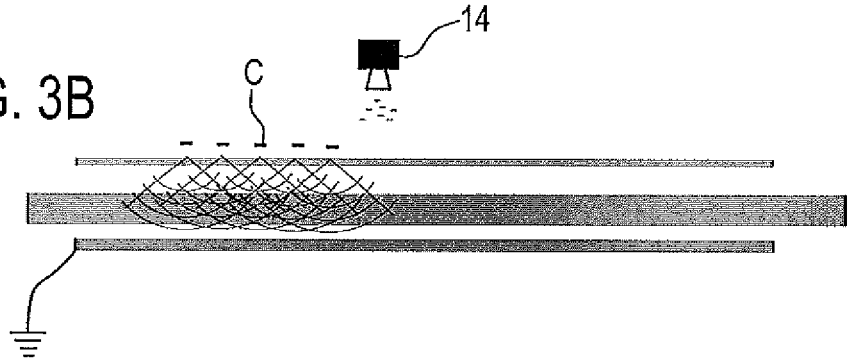
Figure 3C:
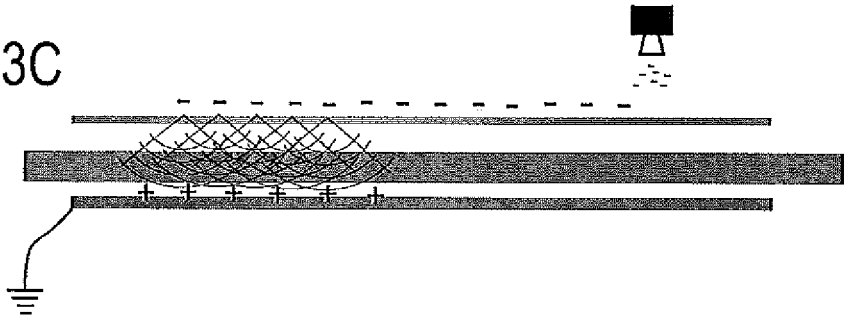
Figure 3D:
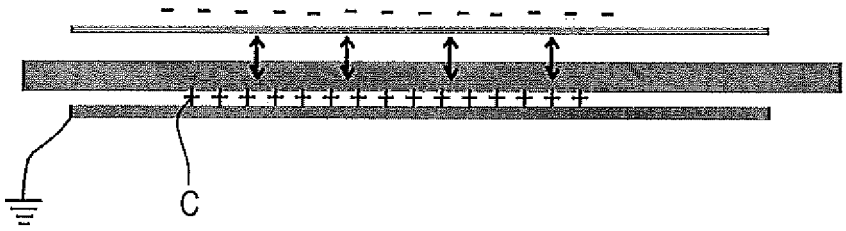

FIGS. 1 and 2 illustrate a preferred embodiment 10 of an apparatus for processing a material 11, in particular for cutting the material 11 into a plurality of pieces, preferably used for making respective items of clothing, that is, garments, apparel, or the like.

The material comprises a respective layer, especially in a tape- or band-like form, in particular made of fabric or the like and, possibly, a secondary layer, preferably in the form of a respective sheet, especially made of paper material, in particular of paper, which is in particular designed for tracing lines for defining corresponding shapes, or shaped profiles, defining respective pieces of clothing and/or corresponding alphanumeric writing or the like for identifying the corresponding pieces.

The secondary layer of material is positioned above the primary layer, and in particular is intended to be cut together with the primary layer.

As may be inferred from FIGS. 1 and 2, the apparatus comprises a respective surface 12 for supporting, in particular for resting, the material 11, at a respective processing zone, in particular for cutting the material.

As illustrated, the supporting surface is preferably in the form of a flat surface 12.

This preferred embodiment of the apparatus 10 also comprises means for cutting the material, preferably at the supporting surface 12, that is, resting on the supporting surface 12.

These cutting means are not illustrated in detail in the accompanying drawings and might also be made as shown in international patent application WO2010/073269, which is in the name of the same applicant, the description in that patent being incorporated herein by reference.

Preferably, the cutting means are in the form of corresponding circular blade means, in particular which cut the material engaging against the underlying supporting surface 12, the cutting means being supported by a corresponding head, or movable unit, 15, preferably along the supporting surface 12 and along the material 11, supported on this. In practice, the cutting means move transversely to the head defining corresponding cutting trajectories or simply movement according to respective coordinates which are longitudinal and transversal to the apparatus or supporting surface.

Advantageously, the apparatus according to the invention comprises means designed to generate a field of electrostatic attraction of the material 11 on the supporting surface 12.

Advantageously, the means designed to generate a field of electrostatic attraction of the material 11 on the supporting surface 12 are in the form of means which can be activated and deactivated, in particular using corresponding electronic control means, preferably comprising computerised means for controlling the apparatus for processing or cutting the material.

Advantageously, the means designed to generate a field of electrostatic attraction of the material 11 on the supporting surface 12 comprise means designed to apply, or to induce, electrical charges on the material 11.

More specifically, the electrical charges may be in the form of positive or negative electrical charges, and preferably in the form of negative electrical charges, as illustrated in FIGS. 3A to 3D.

Advantageously, the means designed to generate a field of electrostatic attraction of the material on the supporting surface 12 are in the form of means designed to induce a homogeneous distribution of electrical charges on the material 11.

More specifically, the means designed to induce the electrical charges on the material comprise means 14 for emitting electrical charges or ionizing means.

Further advantageously, the means for emitting electrical charges comprise a respective elongate ionizing bar 14, in particular elongate transversely to the longitudinal direction of extension of the supporting surface 12 and of extension of the material 11 to be processed.

Advantageously, the electrical charges are applied at the outer face of the material 11, namely, on the face of the material which is opposite the face resting on the surface 12 for supporting the material, as may be clearly inferred from FIGS. 3A to 3D.

In other words, the electrical charges are emitted and applied at the outer face of the material, namely, on the face of the material opposite the face of the same material which rests on, or is directed towards, the surface 12 supporting the material.

The electrical charges, in particular in the form of negative electrical charges, are denoted by reference "C". The same reference "C" also denotes the electrical charges, preferably positive, acting on the side of the supporting surface 12, as described in more detail below.

Preferably, the means for emitting electrical charges operate before the material is conveniently processed, in particular before the material 11 is conveniently cut, and in any case after the same material has been laid out flat on the supporting surface 12.

As may be clearly inferred from FIGS. 1 and 2, the means 14 for emitting electrical charges are at the material 11, in particular when the same material is positioned on the surface 12 supporting the same material, especially defining the supporting surface of the material on which the cut is made.

More specifically, the means 14 for emitting electrostatic, or electrical, charges are positioned above the material 11, and in particular above the surface 12 supporting the same material 11.

More specifically, the means 14 for emitting electrostatic, or electrical, charges are spaced, more specifically spaced perpendicularly, from the material, and in particular are spaced, more specifically perpendicularly spaced, from the surface 12 supporting the same material 11.

Advantageously, the means 14 for emitting electrical charges extend parallel to the material 11, and in particular parallel to the surface 12 supporting the material 11.

As illustrated, the material 11 and/or the surface 12 supporting the same material 11 extend mainly along a longitudinal direction of extension of the apparatus.

Advantageously, the means 14 for emitting electrical charges extend transversely to the material 11 and/or to the surface 12 supporting the same material 11.

Advantageously, the means 14 for emitting electrical charges and the material 11, and/or the surface 12 supporting the same material 11, are movable relative to each other.

More specifically, the means 14 for emitting electrical charges are movable, in particular in a parallel fashion, with respect to the material 11 and/or to the surface 12 supporting the material.

More specifically, the means 14 for emitting electrical charges are movable longitudinally to the material 11 and/or to the surface 12 supporting the same material 11, as shown by the arrow F in FIG. 1.

More specifically, the surface 12 supporting the material 11 is defined by the upper face of a corresponding supporting sheet 13.

The supporting sheet 13, that is, the supporting surface 12, is preferably made of dielectric material, and preferably comprises glass, that is, it is made completely or mainly of glass.

Advantageously, the means designed to generate a field of electrostatic attraction of the material 11 on the supporting surface 12 also comprise means 16 designed to induce electrical charges on the surface 12 supporting the material 11.

Advantageously, the means designed to generate a field of electrostatic attraction of the material 11 on the supporting surface 12 comprise means 16 designed to induce a homogeneous distribution of electrical charges on the surface 12 supporting the material 11.

Advantageously, the means 16 designed to generate a field of electrostatic attraction of the material 11 on the supporting surface 12 comprise means designed to induce electrical charges below the surface 12 supporting the material, in particular below the sheet 13 defining the supporting surface 12.

Advantageously, the means designed to induce a charge at the supporting surface comprise means 16 made of electrically conductive material, in particular metallic material.

As illustrated, advantageously, the means made of electrically conductive material are positioned at, in particular below, the supporting surface 12, in particular below the sheet 13 defining the supporting surface 12.

Advantageously, the means 16 made of electrically conductive material are fixed relative to the supporting surface 12, in particular being integral with the sheet 13 defining the supporting surface 12.

Advantageously, the means 16 made of conductive material extend parallel to the surface 12 supporting the material, in particular parallel to the sheet 13 defining the surface supporting the material.

More specifically, the means made of material are in the form of a respective plate 16, preferably made of metal.

Advantageously, the means 16 made of electrically conductive material are in contact with the lower face of the sheet 13 defining the supporting surface 12, that is, with the face of the sheet 13 which is opposite the face of the sheet 13 which defines the surface 12 supporting the material 11.

Advantageously, there are means 17 designed to induce a static distribution of electrical charges in the means 16 made of electrically conductive material.

Advantageously, the means 16 made of electrically conductive material are in connection, by the electrical cable 171, with an earth 172, in such a way that a weak electrical current can be generated to earth, which is such as to induce a static distribution of electrical charges, in particular positive "C," on the means made of an electrically conductive material.

This defines a corresponding and economically advantageous preferred embodiment of the means designed to induce a static distribution of electrical charges in the means 16 made of electrically conductive material.

To enable the material once processed, in particular cut, to be easily removed from the supporting surface 12, that is to say, conveniently processed without obstacles for subsequent processing, there are advantageous means 18 designed to neutralise an electrical charge which is present on the material 11, and more specifically, the electrical charge which has been previously induced or applied on the material.

Advantageously, the means designed to neutralise the electrical charge of the material 11 are in the form of de-ionizing means, and in particular in the form of a respective de-ionizing bar 18.

In particular, the de-ionizing bar 18 is in the form of a bar transversely elongate to the longitudinal direction of extension of the supporting surface 12 and of extension of the material 11 to be processed.

Advantageously, the means 18 designed to neutralise the electrical charge of the material 11 are at same material 11, in particular when the same material is positioned on the surface 12 supporting the same material, especially defining the supporting surface of the material on which the cut is made.

Advantageously, the means 18 designed to neutralise the electrical charge of the material 11 operate after the material has been conveniently processed, in particular after the material 11 has been conveniently cut.

More specifically, the means 18 designed to neutralise the electrical charge of the material 11 are above the material 11, in particular above the surface 12 supporting the same material 11.

As illustrated, the means 18 designed to neutralise the electrostatic, or electric, charge of the material 11 are spaced from the material 11, more specifically perpendicularly spaced from the material 11, and, according to another viewpoint, are spaced, more specifically perpendicularly spaced, from the surface 12 supporting the same material 11.

Advantageously, the means 18 designed to neutralise the electrical charge of the material 11 extend parallel to the material 11, in particular to the surface 12 supporting the same material 11.

Further advantageously, the means 18 designed to neutralise the electrical charge of the material 11 extend transversely to the material 11 and/or to the surface 12 supporting the same material 11.

Advantageously, the means 18 designed to neutralise the electrical charge of the material 11 and the material 11, and/or the surface 12 supporting the same material 11, are movable relative to each other.

Advantageously, the means 18 designed to neutralise the electrical charge of the material 11 are movable, in particular in a parallel fashion, with respect to the material 11 and/or to the surface 12 supporting the same material 11.

Advantageously, the means 18 designed to neutralise the electrical charge of the material 11 are movable longitudinally to the material 11 and/or to the surface 12 supporting the same material 11.

Advantageously, the means 18 designed to neutralise the electrical charge of the material 11 are movable together, in particular on same movable unit, with the means 14 for emitting the electrical charges, in particular on the material 11.

Advantageously, there are means for activating and deactivating the means 14 for emitting electrical charges.

Advantageously, there are also means for activating and deactivating the means 18 designed to neutralise the electrical charge of the material, more specifically operating in an alternating manner to the status of activating and deactivating the means 14 for emitting electrical charges.

Preferably, when the means 18 designed to neutralise the electrical charge of the material 11 and the means 14 for emitting the electrical charges on the material 11 are transported on the same movable unit, the means for activating and deactivating the means 14 for emitting electrical charges activate the emission of the charges during the step for feeding the material 11, as shown in FIGS. 3A to 3D. During this step, the means 18 for neutralizing the electrical charge are obviously deactivated. Next, upon completion of the cutting operation, the means for neutralizing the charge may be activated, during a corresponding movement of the movable unit relative to the material, with the means 14 for emitting electrical charges, which are, in a non-activated condition.

Advantageously, the apparatus comprises means 20 designed to convey the electrical charges "C" on the material 11.

In practice, advantageously, the apparatus according to the invention comprises means 20 designed to convey, or to transport, electrical charges.

Advantageously, the means 20 designed to convey the electrical charges, transport or convey the electrical charges on the material 11.

Preferably and advantageously, the means 20 designed to convey the electrical charges are in the form of means for blowing a corresponding flow of air towards the material 11 and/or towards the surface 12 supporting the material 11.

In practice, there are means 20 for blowing a flow of air towards the material 11 and/or towards the surface 12 supporting the material 11, which convey respective electrical charges.

Further advantageously, the means 20 designed to convey the electrical charges are in the form of an elongate blowing bar, or blade 20.

Advantageously, the means 20 designed to convey the electrical charges are at, or close to, the means 14 for emitting electrical charges, in such a way as to appropriately convey the electrical charges which are emitted from these means.

Advantageously, the means 20 designed to convey the electrical charges are at the material 11 positioned on the surface 12 supporting the material 11, in particular when the same material is positioned on the surface 12 supporting the same material, especially defining the supporting surface of the material on which the cut is made.

More specifically, the means 20 designed to convey the electrical charges are above the material, and/or above the surface 12 supporting the same material.

More specifically, the means 20 designed to convey the electrical charges are spaced from the material 11, more specifically perpendicularly spaced from the material 11, in particular being spaced, more specifically perpendicularly spaced, from the surface 12 supporting the same material 11.

Advantageously, the means 20 designed to convey the electrical charges extend parallel to the material 11, and/or to the surface 12 supporting the same material.

More specifically, the means 20 designed to convey the electrical charges extend transversely to the material 11, and/or to the surface 12 supporting the material 11.

Advantageously, the means 20 designed to convey the electrical charges on the material 11, and/or the surface 12 supporting the same material 11, are movable relative to each other.

Advantageously, the means 20 designed to neutralise the electrical charges are movable, in particular in a parallel fashion, with respect to the material 11 and/or to the surface 12 supporting the same material 11.

More specifically, the means 20 designed to neutralise the electrical charges are movable longitudinally to the material 11 and/or to the surface 12 supporting the same material 11.

Advantageously, the means 20 designed to convey the electrical charges are movable together with the means for emitting the electrical charge 14 and/or the means 18 designed to neutralise the electrical charge of the material, being carried in particular on the same movable unit as the means for emitting the electrical charge 14 and/or the means 18 designed to neutralise the electrical charge of the material.

Advantageously, there are means for activating and deactivating the means 20 designed to convey the electrical charges, which operate simultaneously and/or in accordance with the status of activating and deactivating the means 14 for emitting electrical charges. More specifically, when the means for emitting electrical charges are activated or deactivated, the means for conveying the electrical charges 20 are also activated or deactivated.

Advantageously, the cutting means used in this apparatus are movable together with, in particular on the same unit as, one or more of the means 20 designed to convey the electrical charges, the means 18 designed to neutralise the electrical charge of the material, and the means 14 for emitting electrical charges.

In practice, advantageously, one or more of the means 20 designed to convey the electrical charges, the means 18 designed to neutralise the electrical charges of the material, and the means 14 for emitting electrical charges are supported on the same movable cutting head of the material, the head supporting corresponding means for cutting the material, in particular of the rotary blade type. More specifically, when the cutting head comprises a pair of supporting rollers sliding on the product 11 and on the underlying supporting surface 12, the rollers being longitudinally spaced from each other and the cutting means extending between the rollers, and one or more of the means 20 designed to convey the electrical charges, the means 18 designed to neutralise the electrical charge of the material and the means 14 for emitting electrical charges, these can also extend between the supporting rollers sliding on the product and supporting surface 12.

As can be inferred from FIGS. 3A to 3D, according to a preferred procedure suitable for generating a convenient electrostatic field of attraction, an ionizing device 14 firstly moves above the material situated on the supporting surface 12 of the sheet 13, made of insulating or dielectric material, conveying the electrical charges, in particular negative, emitted by the ionizer 14 on the surface above the same material 11.

This achieves, due to the effect of the connection to earth of the means, or plate, 16 made of electrically conductive material, located below the supporting surface 12 or the sheet 13 for defining the supporting surface 12, the attraction of positive electrical charges at the upper surface of the conductor plate 16, with the generation of a corresponding weak electrical current towards the earth point 172.

After having processed, that is, cut, the material, the de-ionizing bar 18 may be passed over the material 11 and the material can be conveniently released and suitable processed downstream of the apparatus.

In practice, this provides an apparatus which is particularly effective and of limited cost, which is suitable for generating an advantageous and effective field of electrostatic attraction between the material to be processed, in particular to be cut, and the corresponding supporting surface of the material at the zone in which the material must be processed, that is, cut.

Advantageously, the dielectric or insulating supporting surface 12 might be made of any suitable and desired material, in particular a material which is different from glass, for example, it could be made from rubber or felt.

It is also possible that one or more of the means 20 designed to convey the electrical charges, the means for emitting the electrical charge 14 and the means 18 designed to neutralise the electrical charge of the material have an inclination different from the one illustrated in FIG. 2, that is, they are conveniently tilting, as shown by the corresponding two-way curved arrows of FIG. 2.

It is understood that although not particularly illustrated in the accompanying drawings, it is also imaginable that the apparatus comprises further means of processing material, in particular positioned on the supporting surface, especially in the form of means for forming reference points, or small holes, on the material or fabric and/or means for tracing lines, preferably defining shaped profiles of respective pieces and/or alphanumeric writing for identifying respective pieces on a corresponding material or sheet of paper, for example both as illustrated in patent application WO2014/132214, which is in the name of the same applicant, the description in that patent being incorporated herein by reference.

More specifically, the further means may be situated upstream, downstream and/or at the cutting zone of the material.

The invention described has evident industrial applications. It would be obvious to one skilled in the art that several changes and modifications can be made to the invention without departing from the spirit and scope of the invention, described in depth above. More specifically, one skilled in the art could easily imagine further embodiments of the invention comprising one or more of the features described herein. It will also be understood that all the details of the invention may be substituted by technically equivalent elements.

The invention claimed is:

1. An apparatus (10) for cutting a material (11), the apparatus comprising:

a supporting surface (12) for resting the material, the supporting surface (12) being formed by an upper face of a supporting sheet (13), said supporting sheet (13) being made of a dielectric material;

cutting means for cutting the material on the supporting surface (12); and field generating means configured to generate a field of electrostatic attraction of the material on the supporting surface by inducing a first electrical charge below the supporting surface (12) supporting the material, the field generating means comprising inducing means (16) positioned beneath the supporting sheet (13) and constituted by a metallic, electrically conductive material having a connection to earth, and the field generating means further comprising emitting means (14) that applies a second electrical charge to an outer face of the material that faces away from the supporting surface (12), the second electrical charge being of opposing polarity to the first electrical charge.

2. The apparatus according to claim 1, wherein the field generating means homogeneously distribute electrical charges upon the material (11).

3. The apparatus according to claim 1, wherein the emitting means comprises an ionizing bar (14).

4. The apparatus according to claim 1, wherein the emitting means (14) are positioned above the supporting surface (12) so as to be above the material.

5. The apparatus according to claim 1, wherein the emitting means (14) are perpendicularly spaced from the supporting surface (12) so as to be perpendicularly spaced from the material.

6. The apparatus according to claim 1, wherein the emitting means (14) extend parallel to the supporting surface (12) so as to extend parallel to the material.

7. The apparatus according to claim 1, wherein the supporting surface (12) extends along a longitudinal direction of extension of the apparatus, and the emitting means (14) extend transversely to the supporting surface (12) so as to extend transversely to the material.

8. The apparatus according to claim 1, wherein the emitting means (14) and the supporting surface (12) are movable relative to each other.

9. The apparatus according to claim 1, wherein the emitting means (14) are movable parallel with respect to the supporting surface (12).

10. The apparatus according to claim 1, wherein the emitting means (14) are movable longitudinally to the supporting surface (12).

11. The apparatus according to claim 1, further comprising:

means for activating and deactivating the emitting means (14).

12. The apparatus according to claim 1, wherein the inducing means (16) are configured to induce a homogeneous distribution of electrical charges on the supporting surface (12).

13. The apparatus according to claim 1, wherein the inducing means (16) are configured to induce electrical charges below the supporting sheet (13) forming the supporting surface (12).

14. The apparatus according to claim 1, wherein the inducing means (16) are fixed relative to the supporting surface (12).

15. The apparatus according to claim 14, wherein the inducing means (16) is integral with the supporting sheet (13) of the supporting surface (12).

16. The apparatus according to claim 1, wherein the inducing means (16) extend parallel to the supporting sheet (13) of the supporting surface (12).

17. The apparatus according to claim 1, wherein the inducing means (16) are in contact with a lower face of the supporting sheet (13) that faces opposite the upper face of the supporting sheet (13).

18. The apparatus according to claim 1, further comprising:

means (17) for inducing a static distribution of electrical charges in the electrically conductive material of the inducing means (16).

19. The apparatus according to claim 1, further comprising:

neutralizing means (18) that neutralize an electrical charge on the material (11).

20. The apparatus according to claim 19, wherein the neutralizing means comprises a de-ionizing bar (18).

21. The apparatus according to claim 1, further comprising:

means (20) for blowing a flow of air towards the supporting surface (12) thereby to convey electrical charges to the material.

22. The apparatus according to claim 1, wherein the cutting means for cutting the material are mounted on a same movable unit with one or more of the emitting means (14), the neutralizing means (18), and the means (20) for blowing a flow of air towards the supporting surface.

23. The apparatus according to claim 1, wherein the material is a layered material having a tape-like or band-like form.

24. The apparatus according to claim 1, wherein the material is fabric.

25. The apparatus according to claim 1, wherein the material is fabric for clothing.

26. The apparatus according to claim 1, wherein said supporting sheet is formed of glass.

27. The apparatus according to claim 1, wherein said supporting sheet is formed completely of glass.

28. The apparatus according to claim 1, wherein the second electrical charge applied by the emitting means (14) upon the outer face of the material is negative, and the first electrical charge generated by the inducing means (16) positioned beneath the supporting sheet (13) is positive.

* * * * *